US005614687A

United States Patent [19]

Yamada et al.

[11] Patent Number: 5,614,687

[45] Date of Patent: Mar. 25, 1997

[54] APPARATUS FOR DETECTING THE NUMBER OF BEATS

[75] Inventors: Yoichi Yamada; Tomohiko Kimura; Takeaki Funada; Gen Inoshita, all of Tokorozawa, Japan

[73] Assignee: Pioneer Electronic Corporation, Tokyo, Japan

[21] Appl. No.: 573,398

[22] Filed: Dec. 15, 1995

[30] Foreign Application Priority Data

Feb. 20, 1995 [JP] Japan ..... 7-007652

[51] Int. Cl.[6] ..... G10H 7/00

[52] U.S. Cl. ..... 84/662; 84/648

[58] Field of Search ..... 84/648, 649, 651, 84/652, 654, 661, 662, 663, 667, 668

[56] References Cited

U.S. PATENT DOCUMENTS 4,595,930 6/1986 Murakami ..... 84/1.02

4,655,113 4/1987 Bunger et al. ..... 84/1.03

5,256,832 10/1993 Miyake ..... 84/636

5,478,967 12/1995 Saito et al. ..... 84/612

*Primary Examiner*—William M. Shoop, Jr.

*Assistant Examiner*—Marlon Fletcher

*Attorney, Agent, or Firm*—Fish & Richardson P.C.

[57] ABSTRACT

An apparatus for detecting the number of beats in that second time measuring means starts to measure time from a time point when the level of a predetermined frequency component of an input audio signal is once higher than a predetermined level and, after a predetermined period T1 elapses from the time point, the measurement of time by the second time measuring means is terminated at a time point when the level of the predetermined frequency component of the input audio signal is again higher than the predetermined level, thereby to convert a measured period T2 at termination of measuring of the second time measuring means into BPM i.e., the number of beats per predetermined unit time regarding as a unit beat.

10 Claims, 12 Drawing Sheets

APPARATUS FOR DETECTING THE NUMBER OF BEATS

BACKGROUND OF THE INVENTION

1. Field of the Invention

The present invention relates to an apparatus for detecting the number of beats per unit time in a tune.

2. Description of the Related Background Art

Music generally played in discotheques is so-called dance music which is suitable for dancing. However, it is not preferable to change the tempo every time a different piece of music is played, because people dancing in a discotheque may feel difficult to dance to the accompaniment of such tempo-changing music. On the other hand, continuously replaying the same music for a long time, because of not changing the tempo, would cause dancing people to lose their interest in the dancing. Thus, a disk jockey (DJ) to edit pieces of dance music in a discotheque handles a plurality of (for example, two) disk players in order to play the next piece of music (second tune) immediately after the completion of a currently played piece of music (first tune) through a mixer for editing. While playing the first tune with one disk player, the DJ searches for the head of the next tune in the other disk player and controls the disk rotating speed of the other player to match with both the play speeds such that play of the second tune can be started at the time the play of the first tune has been completed.

However, even if the play speeds of the first and second tunes are merely matched with each other, the connection portion between both the tunes will be found as far as rhythms thereof are not the same. Therefore, the DJ detects each number of beats per unit time, for example Beats Per Minute (BPM) of the first and second tunes, and accurately adjusts the rotation speed of the disk in the disk player so as to match both the numbers of beats.

In a conventional method for detecting the BPM, while a DJ listens to a tune, he pushes an input switch of a BPM measuring machine in response to the beat of the tune. The BPM measuring machine has an internal timer which starts measurement of time at the same time as the first pushing of the switch after the detection of the BPM is instructed by another switch and which measures a predetermined period of time, for example 10 seconds. The machine counts the number of pushing of the input switch for the predetermined period, and then calculates the counted number in the term of 60 seconds as a BPM which is displayed on a display or the like.

However, such a conventional method for detecting the BPM is a complicated work for the DJ, because he must repeatedly push the input switch of the BPM measuring machine in accordance with rhythm of the tune, and furthermore the DJ editing the connection of tunes must adjust the play speed of the next tune and set the connection timing of the tunes.

SUMMARY OF THE INVENTION

It is therefore an object of the present invention to provide an apparatus for automatically detecting the number of beats in a tune without a specific manipulation by a user such as an editor and a DJ.

The apparatus for detecting the number of beats according to the present invention is characterized in that the apparatus comprises: extract means for extracting a predetermined frequency component from an input audio signal; level detecting means for generating a detection signal when detecting that a level of the predetermined frequency component in the audio signal extracted by the extract means is higher than a predetermined level; first time measuring means for measuring a predetermined period in response to the detection signal; means for prohibiting the level detecting means from generating the detection signal during measuring time of the first measuring means; second time measuring means for starting to measure time in response to the detection signal and, after that, for terminating to measure time in response to a detection signal newly generated from the level detecting means; and converting means for converting a period of time measured at termination of measuring of the second time measuring means into the number of beats per predetermined unit time regarding as a unit beat.

According to the present invention, the second time measuring means starts to measure time from the time point when the level of the predetermined frequency component of the input audio signal is once higher than the predetermined level and, after the elapsed predetermined period T1 from that time, the measurement of time of the second time measuring means is terminated at the time when the level of the predetermined frequency component in the input audio signal is again higher than the predetermined level, so that a period T2 measured at termination of measuring of the second time measuring means is calculated into BPM i.e., the number of beats per predetermined unit time (e.g., 60 seconds) regarding as a unit beat.

DETAILED DESCRIPTION OF THE PREFERRED EMBODIMENTS

An embodiment of the present invention will hereinafter be described in detail with reference to the accompanying drawings.

Figure 1:
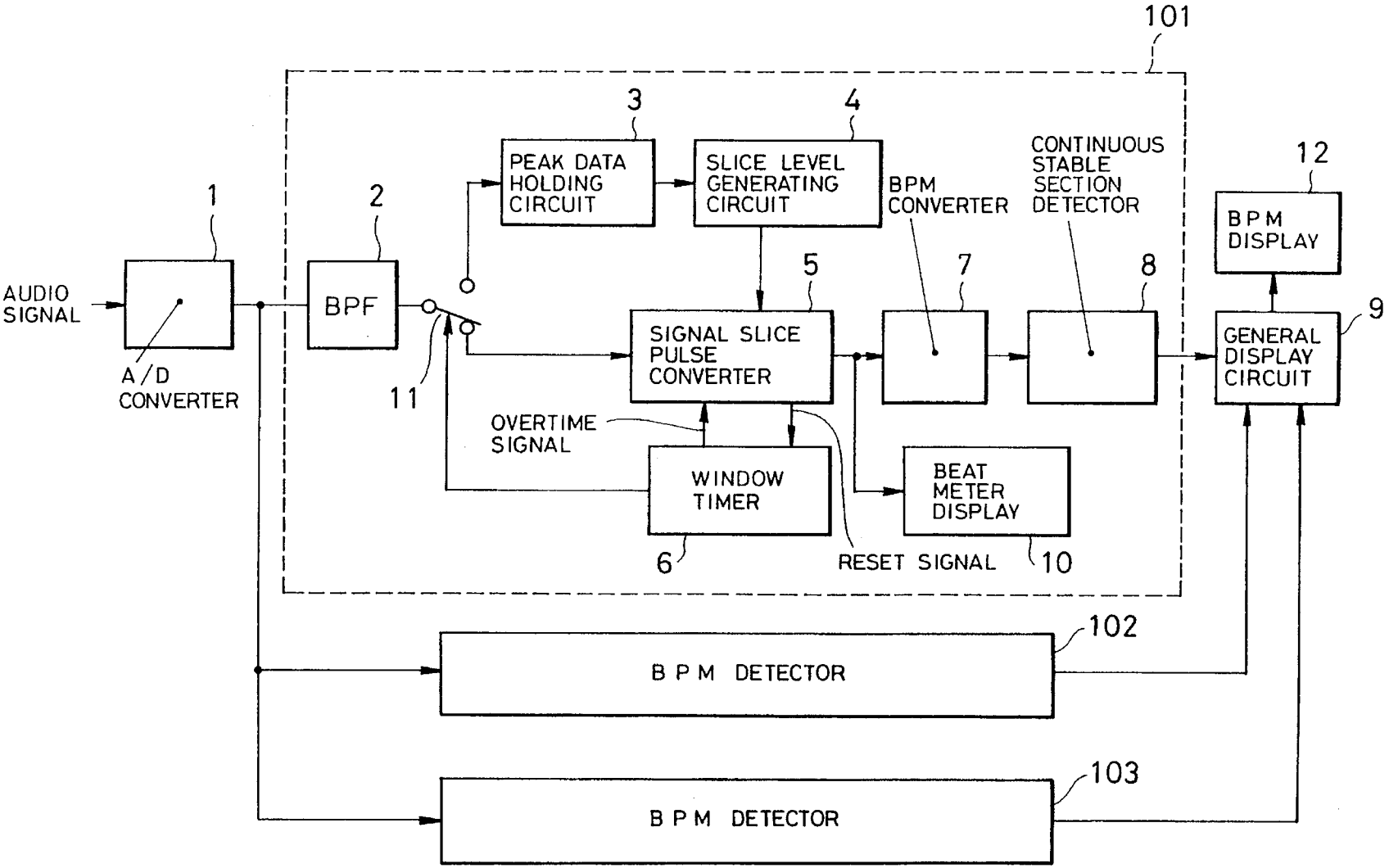
FIG. 1 is a diagram showing an embodiment of an apparatus for detecting the number of beats according to the present invention.

FIG. 1 shows an embodiment of an apparatus for detecting the number of beats according to the present invention. In the BPM measuring apparatus, an analogue audio signal is fed through an A/D converter 1 to three BPM detectors 101–103. The BPM detector 101 is used to detect a low frequency band. The BPM detector 102 is used to detect a mid frequency band. The BPM detector 103 is used to detect a high frequency band.

The BPM detector 101 includes a band pass filter (BPF) 2 which first receives the input signal. The BPF 2 extracts a low frequency component (for example, 20–200 Hz) in the input signal. The output terminal of the BPF 2 is connected to a change-over switch 11. The change-over switch 11 has two fixed contacts. An output signal of the BPF 2 is selectively supplied to one of the two fixed contacts in response to an output signal from a window timer 6 described later. One of the two fixed contacts is connected to a peak data holding circuit 3. A peak data holding circuit 3 detects the maximum value of the supplied signal. The peak data holding circuit 3 is connected to a slice level generating circuit 4. The slice level generating circuit 4 generates a slice level signal indicative of a reduced value, for example a 75% value, of the maximum value detected by the peak data holding circuit 3 and outputs it. The other of the two fixed contacts is connected to a signal slice pulse converter 5. The signal slice pulse converter 5 compares an output level of the BPF 2 supplied through the switch 11 with a slice level generated from the slice level generating circuit 4, and generates a reset signal as well as a high level signal when the output level of the BPF 2 exceeds the slice level. The reset signal is supplied to the window timer 6. The window timer 6 starts to measure a predetermined period T1 of time in response to the reset signal. The predetermined period T1 is a period to ignore sounds other than sounds by which the timing of beats is taken. Assuming that a sixty-fourth musical note is ignored and the maximum value of BPM is set to 160 or less (in tunes played in any discotheques), the value 60000 msec divided by 160 is equal to one beat. Thus, the predetermined period T1 is set as follows:

$$(60000\ \text{msec}/160)\times 15/16=351.5\ \text{msec}.$$

The window timer 6 causes the change-over switch 11 to connect one of the two fixed contacts located at the side of the peak data holding circuit 3 to the BPF 2 during measurement of the predetermined period T1. After completion of the measurement of the predetermined period T1, the window timer 6 makes the change-over switch 11 to change the other of the two fixed contacts to the side of the signal slice pulse converter 5.

The signal slice pulse converter 5 supplies its output signal to the BPM converter 7. The BPM converter 7 starts to measure time at the time that the output level of the signal slice pulse converter 5 becomes a high level and, after that, stops the measurement at the time that the output level of the signal slice pulse converter 5 becomes another high level again so as to obtain a measured period T2 of time. From the measured period T2, a value of BPM is calculated in the BPM converter 7. The output terminal of the BPM converter 7 is connected to a continuous stable section detector 8. Although the operation of the continuous stable section detector 8 is described in detail later, the continuous stable section detector 8 discriminates whether or not the value of BPM output from the BPM converter 7 is continuous and then calculates an average $BPM_{AVE}$ from the values of BPM. The output signal of the continuous stable section detector 8 is an output signal of the BPM detector 101 and supplied to a general display circuit 9. In addition, an output signal of the signal slice pulse converter 5 is supplied to a beat meter display 10 having an LED or a level meter. In accordance with a fluctuation of the output level of the signal slice pulse converter 5, the beat meter display 10 displays light signs or the level.

The BPM detectors 102, 103 are constructed in a manner similar to the BPM detector 101. The BPM detectors 102, 103 are connected to the general display circuit 9 and those output signals of the detectors are supplied to the circuit 9. The BPF 2 of the BPM detector 102 extracts a mid frequency component (for example, 200–2000 Hz) from the input signal. The BPF 2 of the BPM detector 103 extracts a high frequency component (for example, 2000–20000 Hz) from the input signal. A BPM display 12 for displaying the number of beats (BPM) is connected to the general display circuit 9.

The portion including the BPF 2, peak data holding circuit 3, slice level generating circuit 4, signal slice pulse converter 5, window timer 6 and change-over switch 11 is realized in a digital signal processor (DSP). That is, the DSP forms these elements by the execution of programs. In addition, the BPM converter 7, the continuous stable section detector 8 and the general display circuit 9 are realized by the operation of a microcomputer.

Figure 2:
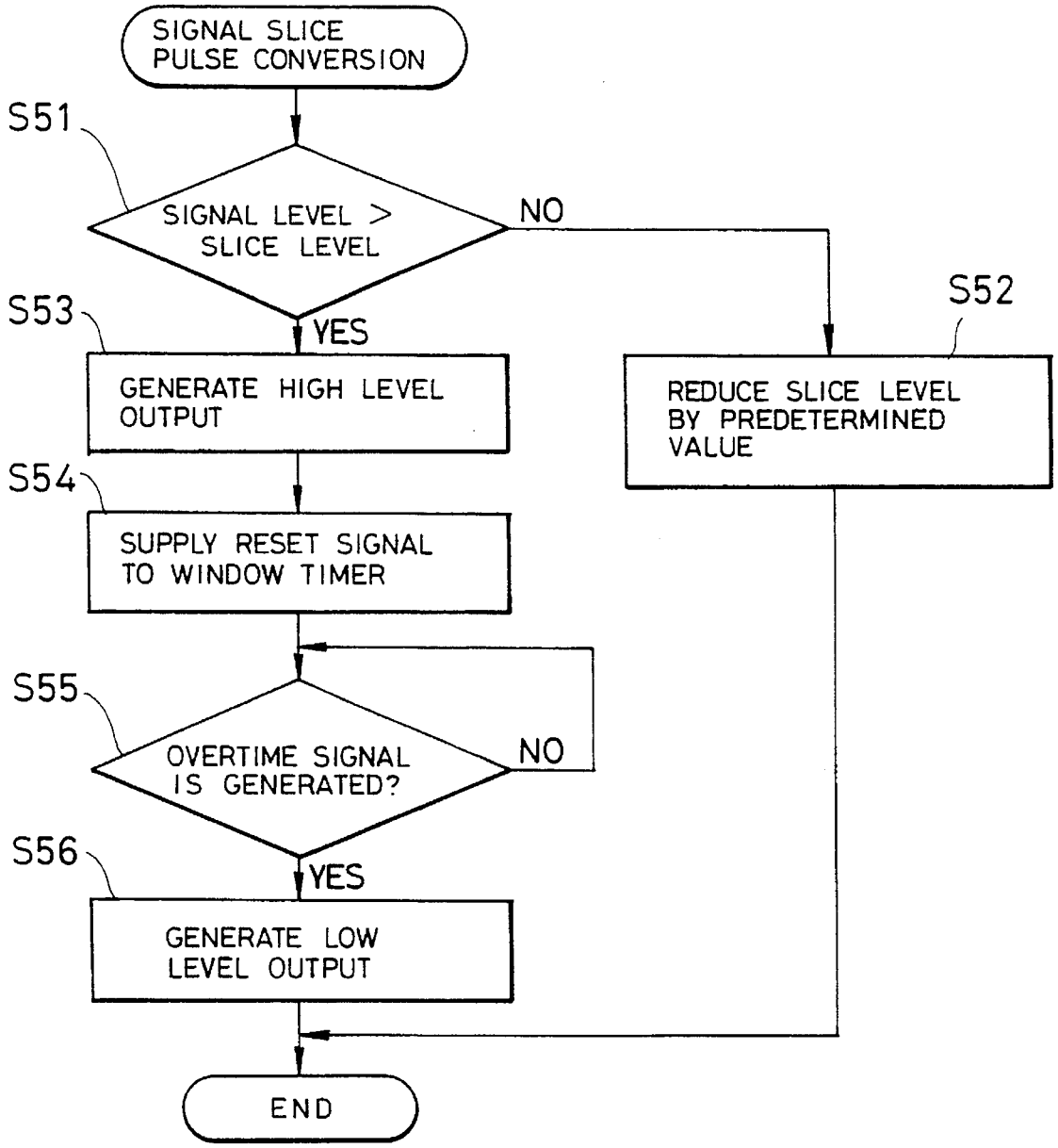
FIG. 2 is a flow chart representing an operation of a signal slice pulse converter in the apparatus of FIG. 1.

In the construction of the above apparatus, after an audio signal is digitized by the A/D converter 1, it is supplied to each of the BPM detectors 101–103. In the operation of the BPM detector 101, first, a low frequency component in the digitized audio signal is extracted in the BPF 2 and then, the extracted component is supplied through the change-over switch 11 to the signal slice pulse converter 5. As shown in FIG. 2, the signal slice pulse converter 5 discriminates whether or not the signal level of the low frequency component of the input audio signal from the BPF 2 is higher than a slice level which is predetermined (step S51). In the BPM detectors 102, 103, the signal levels of the mid and high frequency components are compared to slice levels respectively. When the signal level of the low frequency component ≦ the slice level in step S51, the slice level is reduced by a predetermined value (step S52). On the other hand, the signal level of the low frequency component > the slice level, a high level output is generated (step S53) and then a reset signal is generated and supplied to the window timer 6 (step S54). After the execution of the step S54, the signal slice pulse converter 5 discriminates whether or not an overtime signal showing the termination of a predetermined period T1 is fed from the window timer 6 (step S55). In step S64 described later, the overtime signal is generated from the window timer 6 and then supplied to the signal slice pulse converter 5. In response to the overtime signal, a low level output is generated from the signal slice pulse converter 5 (step S56). This operation is repeated in accordance with a sampling cycle of the A/D converter 1. After the signal slice pulse converter 5 generates a high level output, the change from the high level output to a low level output is equal to a generation of pulse. The initial value of this output is the low level.

The slice level fed from the slice level generating circuit 4 is stored in a memory (not shown) in the signal slice pulse converter 5. The stored slice level is used for the comparing operation in step S51. In addition, the stored slice level is reduced by the predetermined level in step S52 and then becomes a new slice level.

Figure 3:
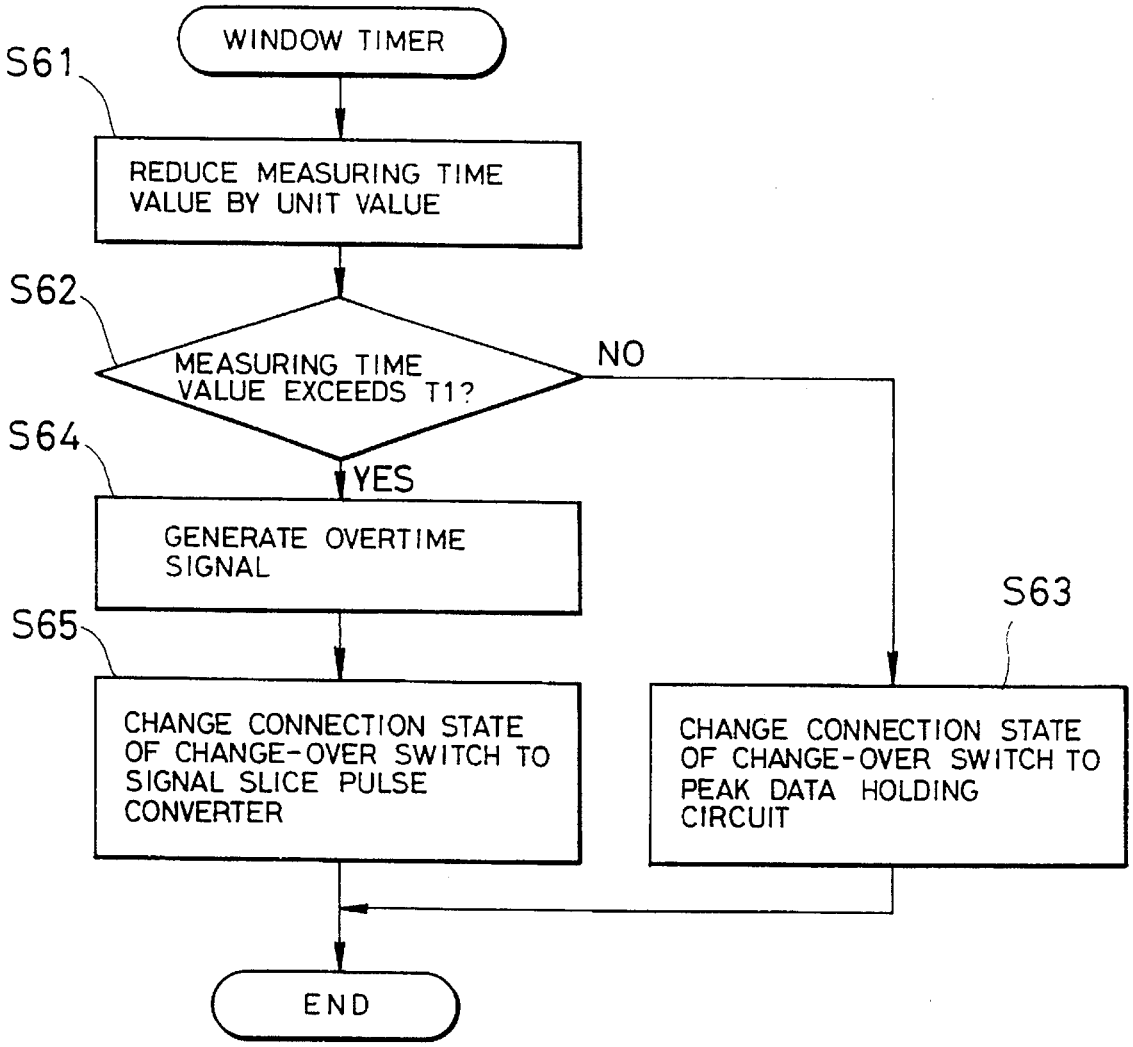
FIG. 3 is a flow chart representing an operation of a window timer in the apparatus of FIG. 1.

When the signal slice pulse converter 5 generates the reset signal, the window timer 6 starts to measure time. The window timer 6 increases a measuring time value by a unit value, as shown in FIG. 3 (step S61), and then discriminates whether or not the measuring time value exceeds the predetermined period T1 (step S62). When the measuring time value does not exceed the predetermined period T1, the window timer 6 causes the change-over switch 11 to change the connection state from the signal slice pulse converter 5 to the peak data holding circuit 3 (step S63). When the measuring time value exceeds the predetermined period T1, i.e., it is overtime, then the window timer 6 generates and supplies the overtime signal to the signal slice pulse converter 5 (step S64) and at the same time, causes the change-over switch 11 to change the connection state to the side of the signal slice pulse converter 5 (step S65). This operation is repeated with a cycle of the unit value.

Figure 4:
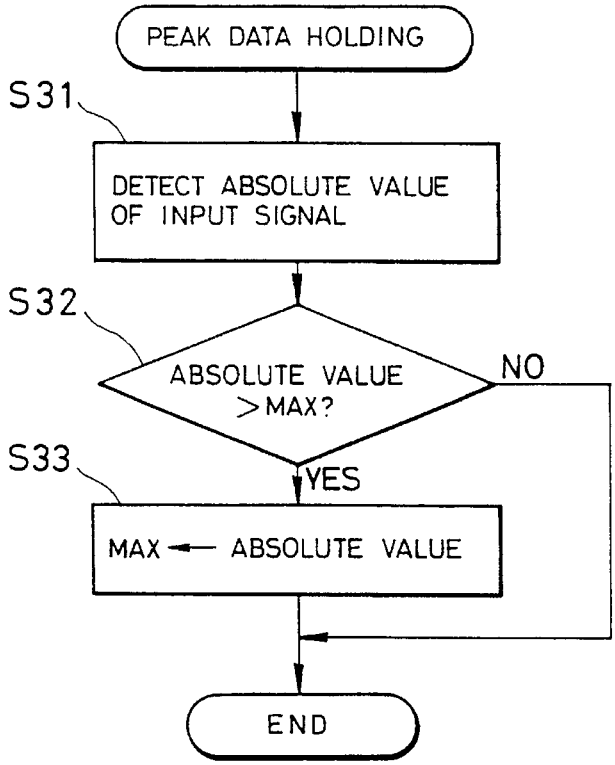
FIG. 4 is a flow chart representing an operation of a peak data holding circuit in the apparatus of FIG. 1.

When the change-over switch 11 selects the way to the peak data holding circuit 3, the signal of the low frequency component supplied from the BPF 2 is fed through the change-over switch 11 to the peak data holding circuit 3. The peak data holding circuit 3 converts the low frequency component signal into an absolute value and then detects and holds its maximum value. As shown in FIG. 4, the peak data holding circuit 3 detects, at every sampling, the absolute value of the low frequency component signal fed from the BPF 2 (step S31) and then discriminates whether or not the absolute value signal level is higher than the maximum value MAX (step S32). When the absolute value signal level > the maximum value MAX, the absolute value signal is regarded as the maximum value MAX (step S33). The peak data holding circuit 3 supplies the maximum value MAX as a data signal to the slice level generating circuit 4.

Figure 5:
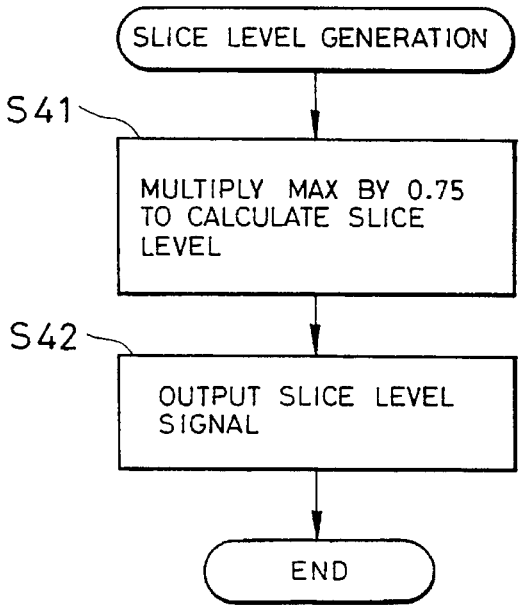
FIG. 5 is a flow chart representing an operation of a slice level generating circuit in the apparatus of FIG. 1.

The slice level generating circuit 4 preforms multiplication as shown in FIG. 5 in which the maximum value MAX detected by the peak data holding circuit 3 is multiplied by 0.75 in order to obtain the multiplied result as a slice level (step S41) and then outputs it as a slice level signal to the signal slice pulse converter 5 (step S42). Since the coefficient 0.75 used in the multiplication of the MAX is an experiential value, the invention is not limited by this value.

Figure 6A:
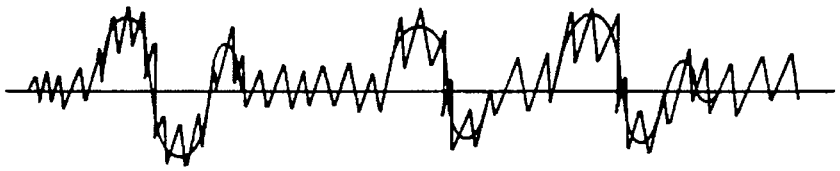
FIGS. 6A to 6D are diagrams showing waveforms of signal in various portions of the apparatus of FIG. 1 respectively.
Figure 6B:
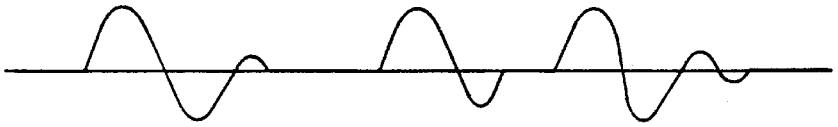
Figure 6C:
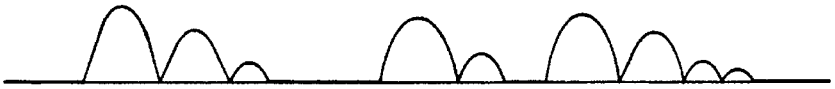
Figure 6D:
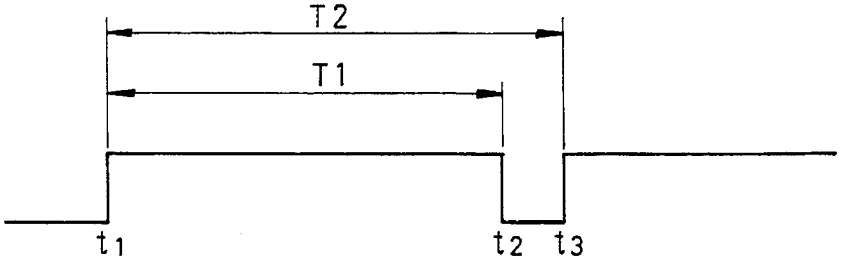

If the input audio signal has a signal waveform as shown in FIG. 6A for example, a signal waveform of the low frequency component passing through the BPF 2 is represented in FIG. 6B. The peak data holding circuit 3 generates a signal waveform having only a plus component as shown in FIG. 6C, by obtaining an absolute value from the output signal of the BPF 2. The maximum value MAX is detected from such a signal waveform in order to determine a slice level. Therefore, as shown in FIG. 6D, when the signal level of the low frequency component passing through the BPF 2 is higher than this slice level, the output of the signal slice pulse converter 5 becomes a high level at a time point $t_1$. The output of the signal slice pulse converter 5 becomes a low level at a time point $t_2$ when the predetermined period T1 has passed from the time point $t_1$.

Figure 7:
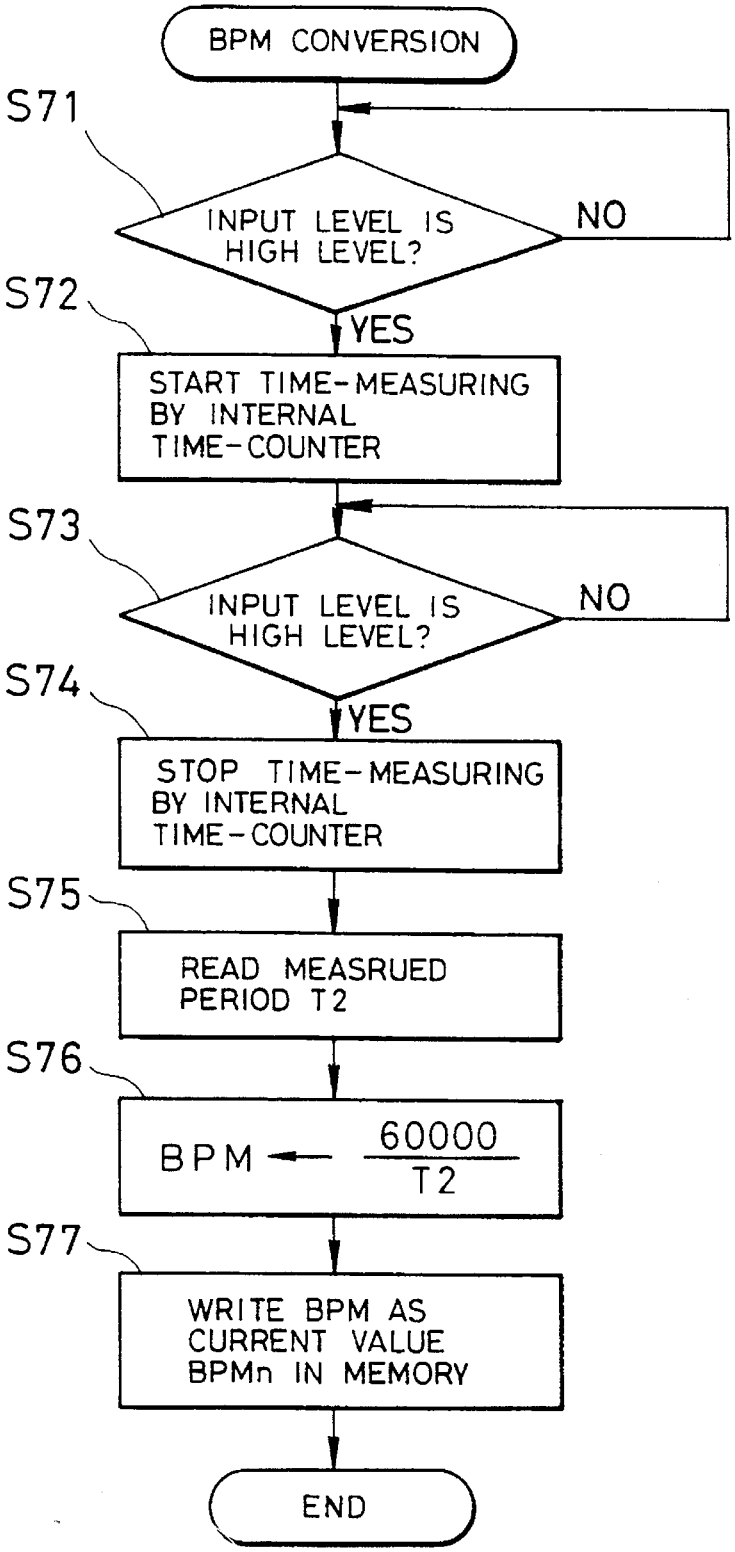
FIG. 7 is a flow chart representing an operation of a BPM converter in the apparatus of FIG. 1.

When the output signal of the signal slice pulse converter 5 is fed to the BPM converter 7, as shown in FIG. 7, then the BPM converter 7 discriminates whether or not the output of the signal slice pulse converter 5 becomes a high level (step S71). When the discrimination is a high level, an internal time-counter (not shown) in the BPM converter 7 starts to measure time from an initial value, for example, 0 (step S72) and then discriminates whether or not the output of the signal slice pulse converter 5 becomes a high level (step S73). After it is determined that the output of the signal slice pulse converter 5 is equal to a high level in step S71, when the output turns to a low level and then returns to a high level again, the returned high level output is detected in step S73.

When the high level is discriminated in the step S73, the time-measuring of the above mentioned internal time-counter is stopped (step S74), the measured period T2 of the internal time-counter is read (step S75). This measured period T2 is the length from the time points $t_1$ to a time point $t_3$ as shown in FIG. 6D illustrating the output signal waveform of the signal slice pulse converter 5. After reading the measured period T2, the number of beats BPM is calculated in such a manner that 60000 is divided by the measured period T2 msec (step S76), and then the number of beats BPM is stored in a memory (not shown) as a current value $BPM_n$ (step S77). The memory individually stores the total 16 values from $BPM_n$ to $BPM_{n-15}$ which are calculated for the past 15th times.

Figure 8:
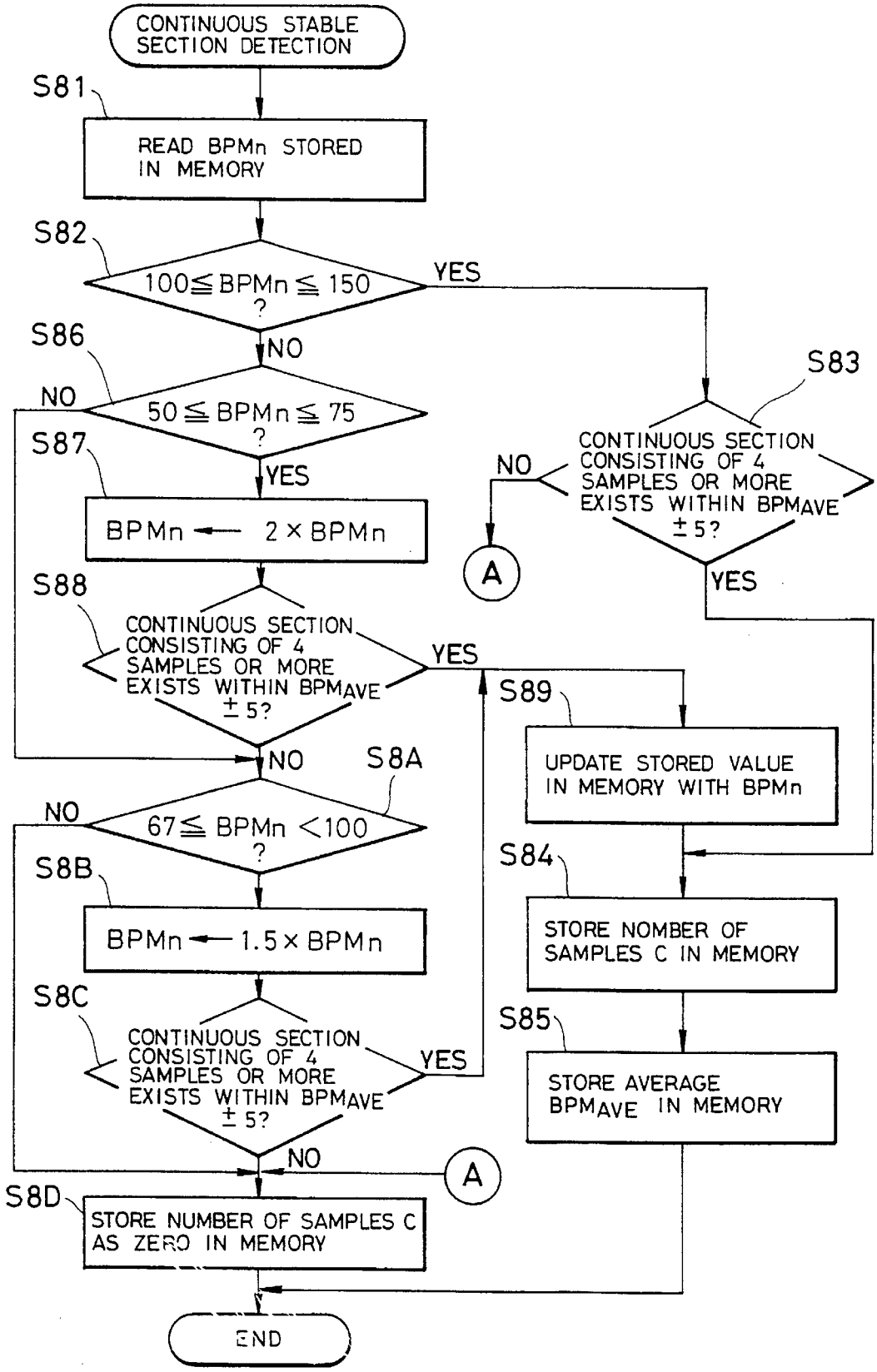
FIG. 8 is a flow chart representing an operation of a continuous stable section detector in the apparatus of FIG. 1.

The continuous stable section detector 8 reads the stored current value $BPM_n$ from the memory as shown in FIG. 8 (step S81) and then discriminates whether or not the current value $BPM_n$ is in the range of from 100 to 150 (step S82). This range of from 100 to 150 of the number of beats is defined since almost tempos of many pieces of music played in a discotheque is usually in the range. When $100 \leqq BPM_n \leqq 150$, the continuous stable section detector 8 discriminates whether or not a continuous section consisting of 4 samples or more exists within $BPM_{AVE}$ plus or minus 5 in the stored values $BPM_n$, $BPM_{n-1}$, . . . , $BPM_{n-15}$ (step S83). When the continuous section consisting of 4 samples or more exists within $BPM_{AVE} \pm 5$, the continuous stable section detector 8 detects the number of samples C in the continuous section and then stores it in the memory (step S84). The continuous stable section detector 8 further stores an average $BPM_{AVE}$ calculated from the number of beats of the continuous section, in the memory (step S85).

The detection of the continuous section consisting of 4 samples or more within $BPM_{AVE}$ plus or minus 5 is performed in such a manner that the continuous stable section detector 8 calculates an average $AVE_m$ from the values of samples from $BPM_n$ to $BPM_{n-m}$ and then discriminates whether or not the difference between each sampled value of $BPM_n - BPM_{n-m}$ and the average $AVE_m$ is within plus or minus 5. In this case, m is one of 3 to 15 and n is one of n to n-12. The memory stores an average $AVE_m$ having the difference between each sampled value of $BPM_n - BPM_{n-m}$ and the average $AVE_m$ being within plus or minus 5 and the number of samples C being large.

When $BPM_n < 100$ or $BPM_n > 150$ in step S82, the continuous stable section detector 8 discriminates whether or not the current value $BPM_n$ is in the range of from 50 to 75 (step S86). When $50 \leqq BPM_n \leqq 75$, the continuous stable section detector 8 multiples this current value $BPM_n$ by two to obtain the current value $BPM_n$ since the current sample has a half musical note (step S87). Subsequently, the continuous stable section detector 8 discriminates whether or not a continuous section consisting of 4 samples or more exists within $BPM_{AVE} \pm 5$ in the current value $BPM_n$ and stored values $BPM_{n-1}$, . . . , $BPM_{n-15}$ (step S88). When the continuous section consisting of 4 samples or more exists within $BPM_{AVE} \pm 5$, the continuous stable section detector 8 updates the stored value with the current value $BPM_n$ obtained in step S87 (step S89) and then advances the operation to step S84.

When $BPM_n < 50$ or $BPM_n > 75$ in step S86, alternatively any sequent section having 4 samples or more does not exist within $BPM_{AVE}\pm5$ in step S88, then the continuous stable section detector 8 discriminates whether or not the current value $BPM_n$ is a value in the range of from 67 to 100 (step S8A). When $67 \leqq BPM_n < 100$, since the current sample is regarded as a dotted quarter musical note, the continuous stable section detector 8 multiples the current value $BPM_n$ by 1. 5 and then regards the multiplied result as the current value $BPM_n$ (step S8B). After that, the continuous stable section detector 8 discriminates whether or not a continuous section consisting of 4 samples or more exists within $BPM_{AVE}\pm5$ in the current value $BPM_n$ and the stored values $BPM_{n-1}, \ldots, BPM_{n-15}$ in a manner similar to step S88 (step S8C). When the continuous section having 4 samples or more exists within $BPM_{AVE}\pm5$, the operation goes to step S89. When any continuous section having 4 samples or more is not obtained, the number of samples C is stored as 0 (step S8D).

Figure 9:
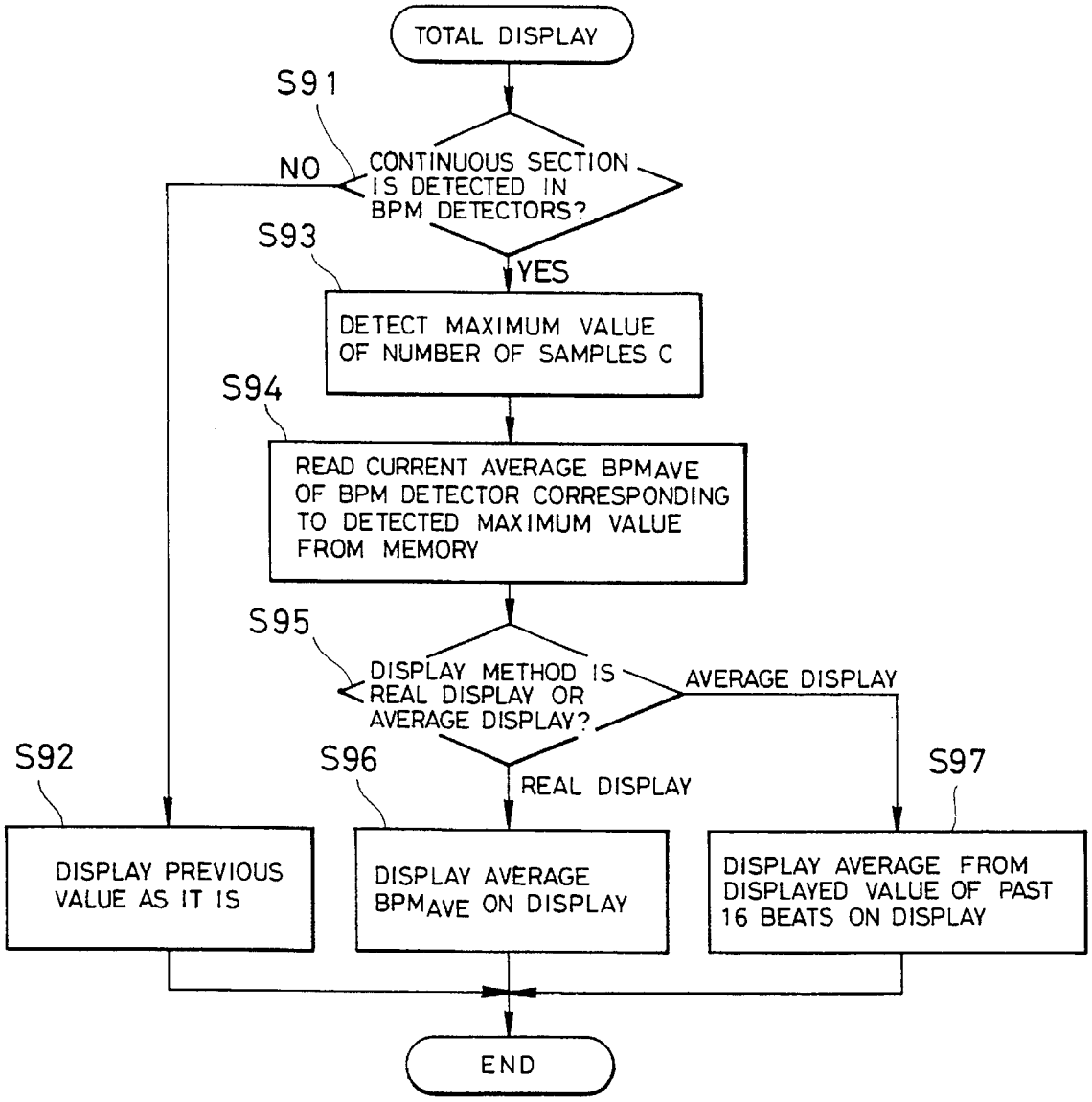
FIG. 9 is a flow chart representing an operation of a general display circuit in the apparatus of FIG. 1.

Since such an operation in the BPM detector 101 is also performed in each of the BPM detectors 102, 103, the number of samples C is determined for the low, mid and high frequency components. Therefore, as shown in FIG. 9, the general display circuit 9 discriminates whether or not the continuous section consisting of 4 samples or more is detected in the BPM detectors 101 to 103 (step S91). This discrimination may be performed from the number of samples C of every BPM detector 101 to 103. When the number of samples C is 0 i.e., no continuous stable section exists at this time, then a BPM display 12 continuously displays the previous numeral value which is being displayed as it is (step S92).

On the other hand, when the continuous section consisting of 4 samples or more is detected in any of the BPM detectors 101–103, the general display circuit 9 selects and detects the maximum value from the numbers of samples C thereof (step S93). If the numbers of samples C of the BPM detector 101 is C1, similarly, the BPM detector 102 is C2, and the BPM detector 103 is C3, then the maximum value is selected from the three numbers C1 to C3. The general display circuit 9 reads the current average $BPM_{AVE}$ of the BPM detector corresponding to the detected maximum value from the memory (step S94). Subsequently, the general display circuit 9 discriminates that a display method is a real display or an average display (step S95). When it is the real display, the general display circuit 9 causes the BPM display 12 to display the average $BPM_{AVE}$ by a numeral value (step S96). When it is the average display, the general display circuit 9 calculates an average from the displayed values of the past 16 beats including the current average $BPM_{AVE}$ and then causes the BPM display 12 to display the calculated average by a numeral value (step S97). The selection of the real display or the average display is performed in accordance with an input operation in a control portion (not shown).

Figure 10:
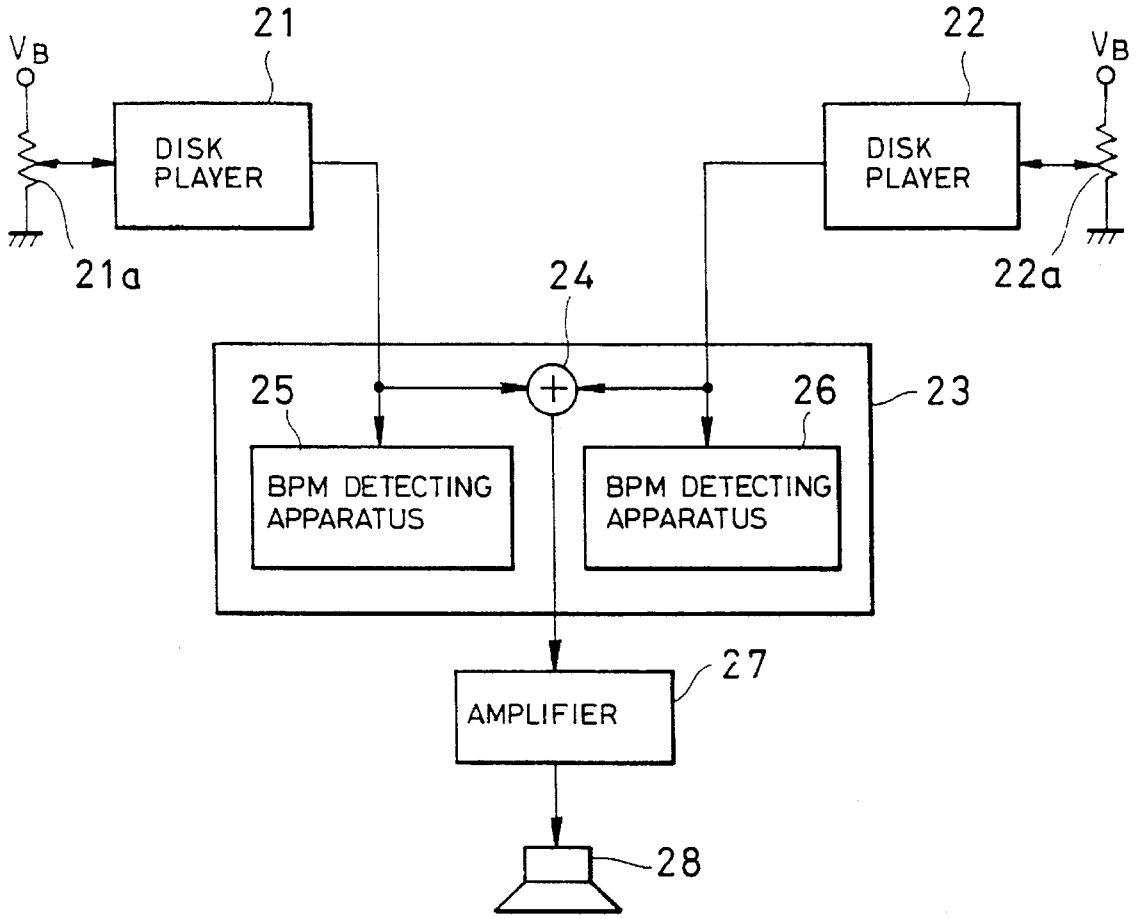
FIG. 10 is a schematic diagram showing a DJ system to which an apparatus for detecting the number of beats according to the present invention is applied.

FIG. 10 shows a DJ system to which an apparatus for detecting the number of beats according to the present invention is applied. This DJ system comprises two disk players 21, 22. The disk players 21, 22 are CD players for example, in which their disk rotating speeds are controlled by adjusting variable resistors 21*a* and 22*a*. Audio signals i.e., reproduced signals output from the disk player 21, 22 are supplied to a mixing device 23. The mixing device 23 comprises an adder 24 connected to the disk players 21, 22, and first and second detecting apparatuses 25, 26 for detecting the number of beats and connected to the disk players 21, 22 respectively. The adder 24 is capable either of mixing and outputting the audio signals from the disk players 21, 22 in a desired mixing ratio or of outputting only one of the audio signals. The first detecting apparatus 25 detects the number of beats of the tune indicative of the audio signal output from the disk player 21. The second detecting apparatus 26 detects the number of beats of the tune indicative of the audio signal output from the disk player 22. An audio signal output from the adder 24 is amplified in an amplifier 27 to supply to a speaker system 28.

Figure 11:
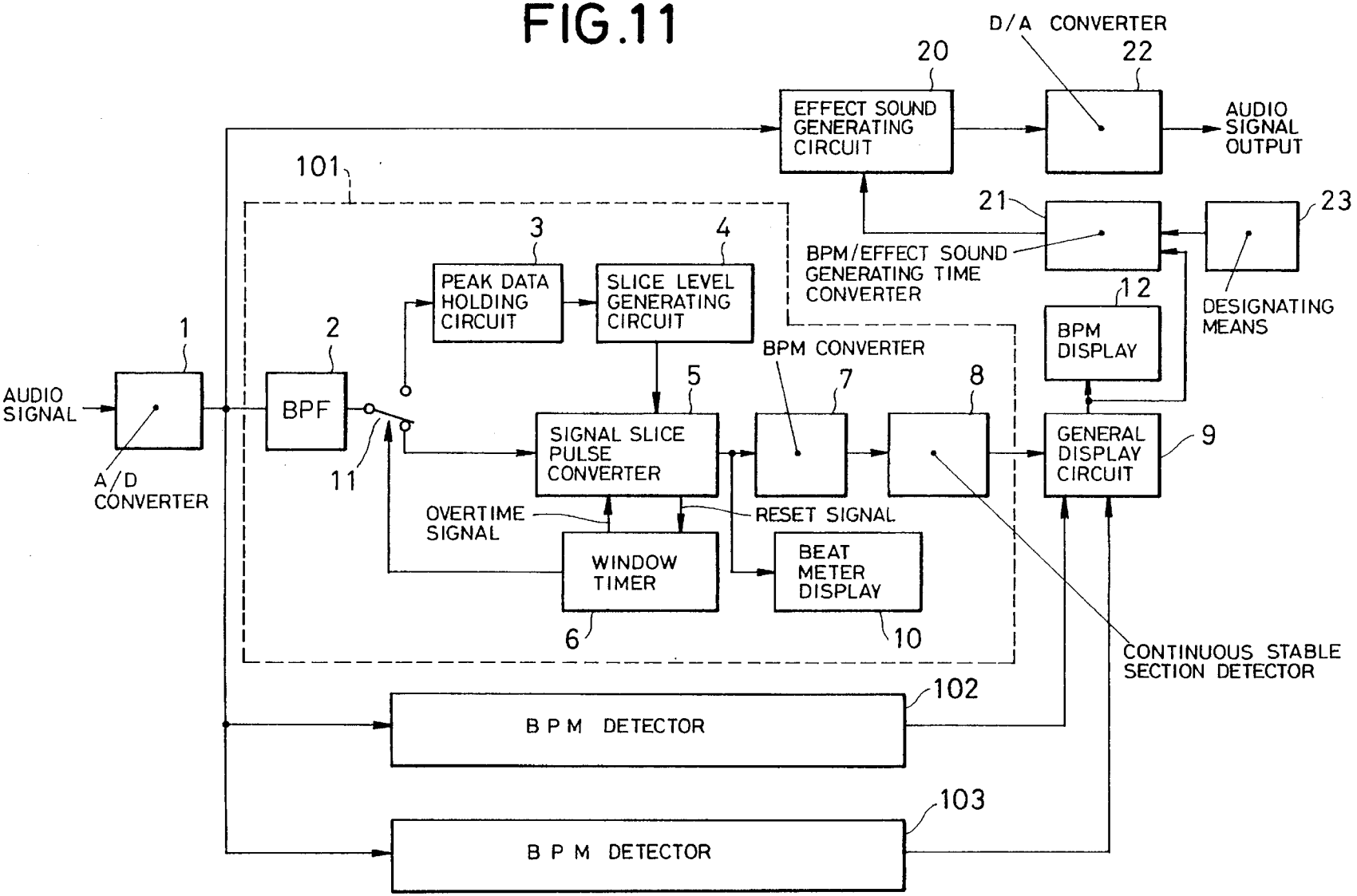
FIG. 11 is a block diagram showing an embodiment to which an apparatus for detecting the number of beats according to the present invention is applied.

FIG. 11 shows an example to which an apparatus for detecting the number of beats according to the present invention is applied. This example system includes an effect sound generating circuit 20 which generates an effect sound signal such as a delayed sound signal generated by delaying an input audio signal by a predetermined period of time, and a panning sound signal generated by varying a stereo balance of an input audio signal at a predetermined interval. The delay period and the panning cycle in the effect sound generating circuit 20 are set in accordance with a control signal supplied from a BPM/effect sound generating time converter 21. The signal output from the effect sound generating circuit 20 is supplied to a D/A converter 22 to convert into an analogue signal. The converted analogue signal drives a speaker system via an external amplifier (not shown). The BPM/effect sound generating time converter 21 converts the number of beats of audio signal output from the general display circuit 9 into a generating period corresponding to the generation-timing of the effect sound designated by a designating means 23 using an interface unit such as a ten key, a specific operational button or a rotary knob. The converted generating period is supplied as a control signal to the effect sound generating circuit 20.

Figure 12:
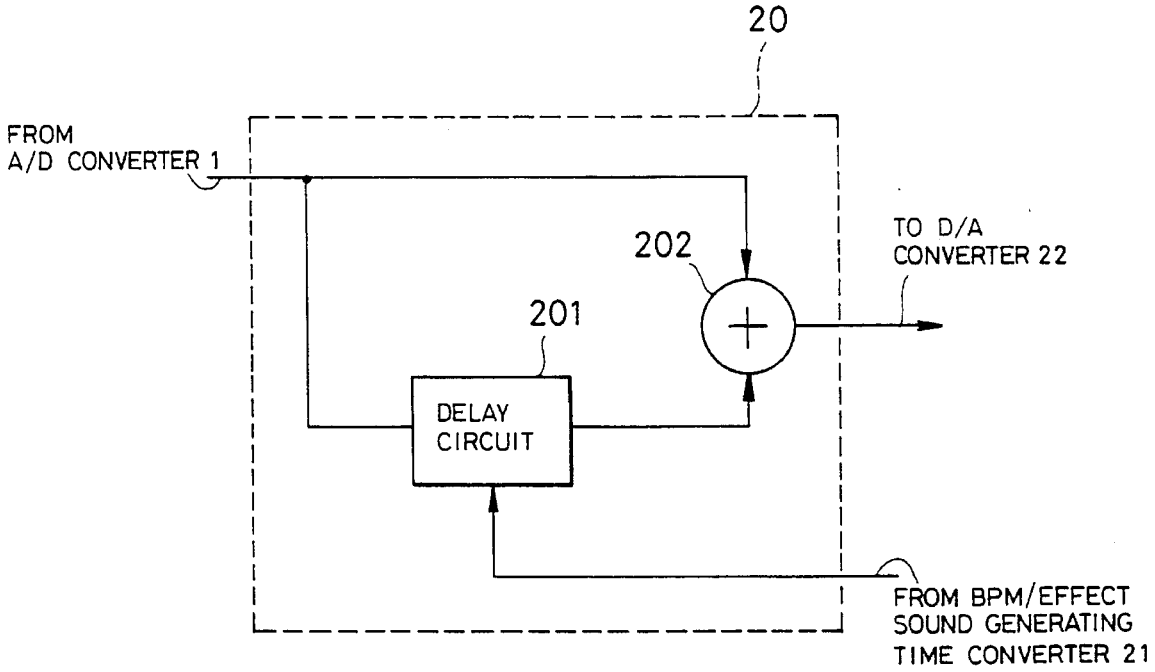
FIG. 12 is a block diagram showing an example of an effect sound generating circuit in the apparatus of FIG. 11.
Figures 13A, 13B, 13C:
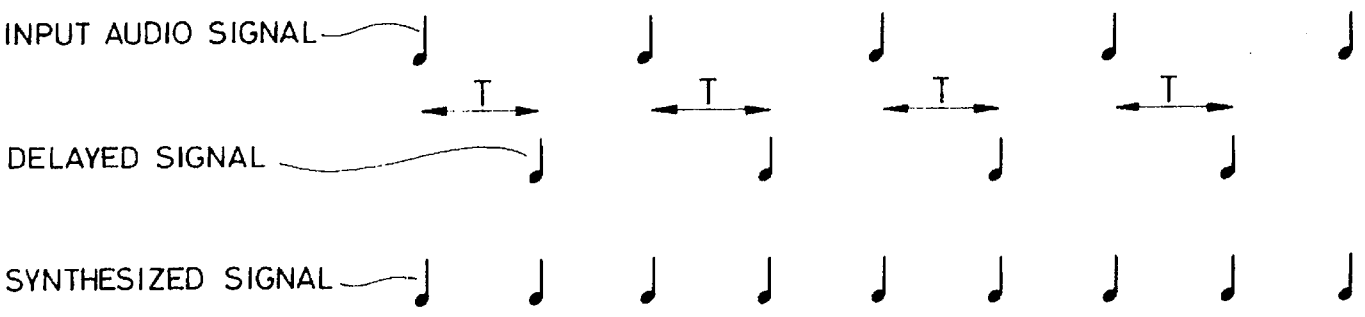
FIGS. 13A to 13C are timing charts representing operations of the effect sound generating circuit of FIG. 12 respectively.

In case that the effect sound generating circuit 20 is used as a delayed sound generating circuit shown in FIG. 12, the control signal is set to a signal representing a delay period in a delay circuit 201 included in the effect sound generating circuit 20. The delayed sound generating circuit 20 comprises a synthesizing circuit 202 which synthesizes an input audio signal delayed by the period represented by the control signal and a non-delayed input audio signal supplied from the A/D converter 1 in order to generate the effect sound signal. The designating means 23 designates the desired number of beats to be sifted as a generation-timing. For example, in case that an effect sound sifted by a half beat with respect to the number of beats (BPM) of an input audio signal is generated, the designating means 23 designates ½ or odd number times of ½ for sifting by a half beat. When a BPM detected on the basis of an input audio signal represented by quarter musical notes as shown in FIG. 13A is 120 in the apparatus for detecting the number of beats, the BPM/effect sound generating time converter 21 defines 60000 msec/120×½ beat=250 msec as a delay period since the generation-timing is a ½ beat, and then the result is supplied as a control signal to the delay circuit 201. The delay circuit 201 delays the audio signal by the delay period T as shown in FIG. 13B, so that the synthesizing circuit 202, i.e., the effect sound generating circuit 20 outputs a synthesized signal including an effect sound signal generated in such a manner that beats (BPM) in audibility becomes double as shown in FIG. 13C. By varying the designated generation-timing, effect sounds containing various rhythms can be generated.

In addition, in case that the effect-sound-generating circuit 20 is used as a panning sound generating circuit, the forgoing control signal is set to a signal representing a panning cycle. That is, an effect sound changing in the stereo balance for right and left channels at a cycle of 250 msec is generated when the above sifting of a half beat is preformed.

Since the number of beats output corresponding to the tempo of the input audio signal from the general display circuit 9, the DJ need not set parameters such as the delay period and panning cycle while monitoring for obtaining the effect sound. Therefore, the apparatus can easily generate an effect sound accurately following the audio signal by only designating the DJ's favorite generation-timing.

Moreover, although, in the above embodiment, the averages $BPM_{AVE}$ are respectively calculated in the low, mid and high frequency components in the input audio signal and one value is selected from the three values of $BPM_{AVE}$, the average $BPM_{AVE}$ may be calculated in only one frequency band and displayed.

In addition, although the window timer 6 is reset at the point $t_1$ as shown in FIG. 6D, the next point when the window timer is reset is a point when the output level of the signal slice pulse converter 5 turns from a low level to a high level after the point $t_3$ when the measuring period T2 is obtained in the above embodiment. However, it is possible that the window timer 6 is reset and starts the measurement of the predetermined period T1 and, at the same time, starts the next measurement of a period T2 at the point $t_3$ when the measuring period T2 is obtained.

Further, the BPM may be calculated not only for each of a plurality of frequency bands in the above embodiment, but also for only a predetermined frequency band.

In the apparatus for detecting the number of beats according to the present invention, second measuring means starts to measure time from a time point when the level of a predetermined frequency component of an input audio signal is once higher than a predetermined level and, after a predetermined period T1 elapses from the time point, the measurement of time by the second time measuring means is terminated at a time point when the level of the predetermined frequency component of the input audio signal is again higher than the predetermined level, so that a measured period T2 at termination of measuring of the second timer means is converted into BPM i.e., the number of beats per predetermined unit time regarding as a unit beat. The apparatus according to the present invention enable to automatically detect the number of beats in a tune without a specific manipulation by a user such as a musical editor, the DJ or the like. Therefore, by using the present apparatus, a user editing the connection between a playing first tune and a second tune to be replayed can readily change and accurately adjust the rotation speed of a disk in a disk player so as to match the numbers of beats of the second tune with that of the first tune.

What is claimed is:

1. An apparatus for detecting the number of beats comprising:

extract means for extracting a predetermined frequency component from an input audio signal;

level detecting means for generating a detection signal when detecting that a level of the predetermined frequency component extracted by said extract means is higher than a predetermined level;

first time measuring means for measuring a predetermined period in response to said detection signal;

means for prohibiting said level detecting means from generating said detection signal during measuring time of said first measuring means;

second time measuring means for starting to measure time in response to said detection signal and, after that, terminating measuring of time in response to a detection signal newly generated from said level detecting means; and converting means for converting a period of time measured at termination of measuring of said second time measuring means into the number of beats per predetermined unit time regarded as a unit beat.

2. An apparatus according to claim 1, further comprising:

peak holding means for detecting a peak level of said predetermined frequency component extracted by said extract means during measuring time of said first time measuring means; and means for multiplying said peak level by a predetermined coefficient and outputting a multiplied resultant value as said predetermined level.

3. An apparatus according to claim 1, wherein said level detecting means reduces said predetermined level by a predetermined value when the level of the predetermined frequency component extracted by said extract means is equal to or less than said predetermined level.

4. An apparatus according to claim 1, further comprising: means for averaging the number of beats currently obtained by said converting means and the individual numbers of beats obtained for the past predetermined times in order to output an average value.

5. An apparatus according to claim 4, further comprising a means for determining when the individual number of beats subsequently obtained is more than a predetermined number and includes an allowable value having said average value, where said average value is selected from said individual numbers of beats.

6. An apparatus according to claim 1, wherein the number of beats are calculated every one of a plurality of frequency bands different to each other in an input audio signal, the numbers of beats of the individual frequency bands are compared to each other and then one of the numbers of beats is selected in response to the resultant of comparison.

7. An apparatus according to claim 1, wherein said predetermined period is a period of the maximum value of the number of beats subtracted by a period corresponding to a last musical note in a series of a predetermined musical notes.

8. An apparatus according to claim 1, further comprising a display for displaying in synchronism with the generation of said detection signal.

9. An apparatus according to claim 1, further comprising:

designating means for designating generation-timing for an effect sound;

calculating means for generating a control signal representing a period for generating an effect sound in accordance with both the designated generation-timing and the number of beats per predetermined unit time converted by said converting means; and effect sound generation means for generating an effect sound signal for said input audio signal in accordance with said control signal.

10. An apparatus according to claim 6, further comprising:

designating means for designating generation-timing for an effect sound;

calculating means for generating a control signal representing a period for generating an effect sound in accordance with both the designated generation-timing and said one of the number of beats; and effect sound generation means for generating an effect sound signal for said input audio signal in accordance with said control signal.

* * * * *